US005537712A

United States Patent [19]

Weber et al.

[11] Patent Number: 5,537,712

[45] Date of Patent: Jul. 23, 1996

[54] VACUUM CLEANER BELT DRIVE RELEASE

[75] Inventors: Vincent L. Weber, North Lawrence; Charles R. Morrow, Alliance, both of Ohio

[73] Assignee: The Hoover Company, North Canton, Ohio

[21] Appl. No.: 407,277

[22] Filed: Mar. 20, 1995

[51] Int. Cl.[6] ..... A47L 5/26

[52] U.S. Cl. ..... 15/391; 15/332

[58] Field of Search ..... 15/391, 390, 389, 15/361, 332, 333

[56] References Cited

U.S. PATENT DOCUMENTS

| | | | |
|---|---|---|---|
| 1,322,235 | 3/1920 | Staples . | |
| 1,438,890 | 12/1922 | Bobst | 15/390 |
| 1,485,188 | 2/1924 | Hoff . | |
| 1,847,314 | 3/1932 | Butzer . | |
| 1,907,692 | 5/1933 | White | 15/389 |
| 1,934,814 | 11/1933 | Myers | 51/176 |
| 1,978,526 | 10/1934 | Eppler, Jr. | 15/390 |
| 2,094,138 | 9/1937 | White | 15/390 |
| 2,148,656 | 2/1939 | Smellie | 15/9 |
| 2,204,912 | 6/1940 | Riebel | 15/16 |
| 2,240,799 | 5/1941 | Riebel | 15/16 |
| 2,287,922 | 6/1942 | White | 15/8 |
| 2,432,086 | 12/1947 | Boisselier | 15/8 |
| 2,497,791 | 2/1950 | Petersen | 51/176 |
| 2,601,698 | 7/1952 | Humphrey | 15/390 |
| 2,619,670 | 12/1952 | Howard | 15/391 |
| 2,627,623 | 2/1953 | Humphrey | 15/372 |
| 2,682,680 | 7/1954 | Trimble | 15/332 |
| 2,782,435 | 2/1957 | Stone | 15/390 |
| 4,217,674 | 8/1980 | Hayashi et al. | 15/361 |
| 4,446,595 | 5/1984 | Nakada et al. | 15/365 |
| 4,685,171 | 8/1987 | Beaudoin | 15/391 |
| 4,748,714 | 6/1988 | Tschudy | 15/390 |
| 4,766,640 | 8/1988 | Martin et al. | 15/390 |
| 5,031,267 | 7/1991 | Bewley | 15/377 |
| 5,165,140 | 11/1992 | Ide | 15/392 |

FOREIGN PATENT DOCUMENTS

| | | | |
|---|---|---|---|
| 247902 | 2/1961 | Australia | 15/390 |
| 621779 | 2/1927 | France | 15/390 |
| 3029285 | 2/1982 | Germany . | |
| 3742785 | 6/1989 | Germany | 15/391 |
| 536139 | 5/1941 | United Kingdom . | |
| 667865 | 3/1952 | United Kingdom | 15/332 |
| 2089463 | 6/1982 | United Kingdom . | |
| 2101473 | 1/1986 | United Kingdom . | |

OTHER PUBLICATIONS

Photograph of Hoover Standard Convertible Cleaner Bottom Plate (1987).

Photograph of Hoover Standard Convertible Die Cast Bottom Plate (1970).

Photograph of Hoover Legacy® Convertible Cleaner Bottom Plate (1989).

*Primary Examiner*—David Scherbel

*Assistant Examiner*—Tony G. Soohoo

*Attorney, Agent, or Firm*—A. Burgess Lowe; Richardson B. Farley

[57] ABSTRACT

A vacuum cleaner includes a pivoting rollered link which insures proper belt tensioning for the agitator belt of the cleaner. This link is abuttingly moved to disengaged non belt tensioning position by engagement of it by the cleaner handle as the handle is moved to upper, storage position.

3 Claims, 4 Drawing Sheets

VACUUM CLEANER BELT DRIVE RELEASE

BACKGROUND OF THE INVENTION

1. Field of the Invention

This invention relates to vacuum cleaners and, more specifically, to a vacuum cleaner having an agitator belt drive release.

2. Summary of the Prior Art

The use of a drive interruption arrangement in a vacuum cleaner is old and well known. These drive release configurations are generally operative at the motor pulley shaft or at the agitator shaft itself. They take the form, generally, of some type of clutch which is positively, selectively, manually lever or button actuated or automatically disengaged such as by handle movement effected by the cleaner operator. Heretofore it is not known that anyone has recognized the inherent advantage of utilizing a well known and old rollered, belt tensioning arm as a mechanism for automatic belt disengagement as positively selected by the cleaner operator.

Accordingly, it is an object of the invention to provide an automatic cleaner agitator belt drive interruption as selected by the operator of the cleaner.

It is an additional object of the invention to use handle movement to disengage a cleaner agitator belt drive.

It is a still further object of the invention to provide a rollered, belt tensioning link engageable by the handle of a cleaner so as to disengage the agitator belt drive.

It is a further object of the invention to provide a belt guard arrangement that aids in belt disengagement from its driving pulley when the belt is placed in loosened condition.

It is a still further object of the invention to provide an improved agitator belt drive release control.

SUMMARY OF THE INVENTION

A vacuum cleaner is provided with a pivoted handle, a motor and belt driving pulley and a forwardly mounted agitator. Intermediate the motor pulley and agitator, a pivoted roller link is disposed and is tension spring urged downwardly against an upper reach of the belt to tension the belt and insure that a driving relationship is maintained between the motor pulley and agitator. The pivoting rollered link includes a rearward extension formed with a tabbed detent that is engageable by a projection on the handle upon forward pivoting of it to storage position. Engagement of the handle projection with the tabbed detent, swings the tensioning link upwardly away from the upper reach of the belt against the action of the tension spring to loosen the belt and disengage the belt drive to the agitator. Thus, handle movement to its stored position places the agitator out of drive to condition the cleaner for bare floors or above the floor cleaning so that they may be easily achieved.

BRIEF DESCRIPTION OF THE DRAWINGS

Reference now may be had to the accompanying Drawings for a better understanding of the invention both as to its organization and function, with the illustration only showing a preferred embodiment, but being only exemplary, and in which.

DETAILED DESCRIPTION OF THE INVENTION

Figure 1:
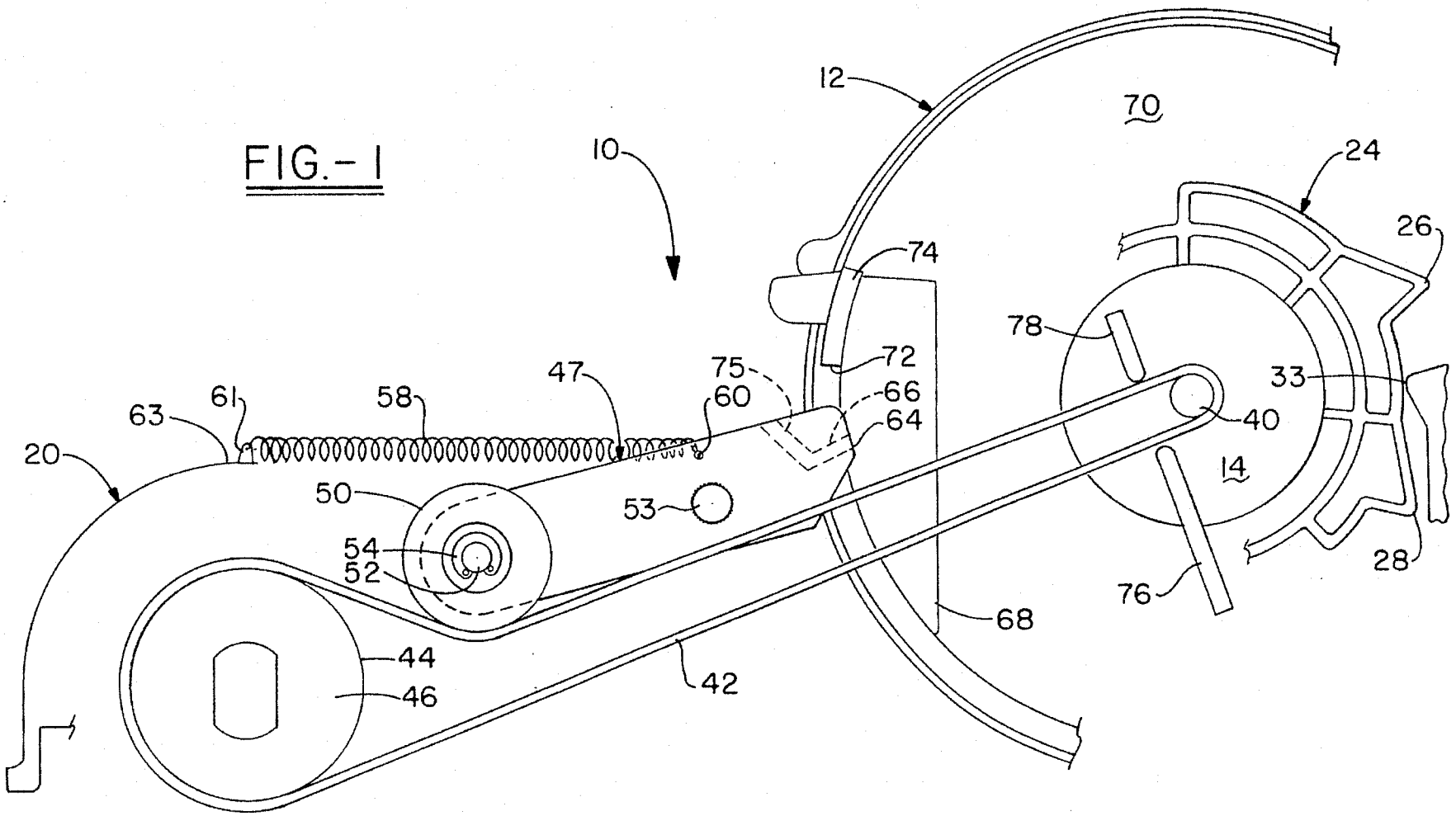
FIG. 1 is a partial and somewhat fragmentary cross-sectional side elevational view of the front side portion of a vacuum cleaner, with the cleaner handle in an operating position and showing its belt drive.
Figure 2:
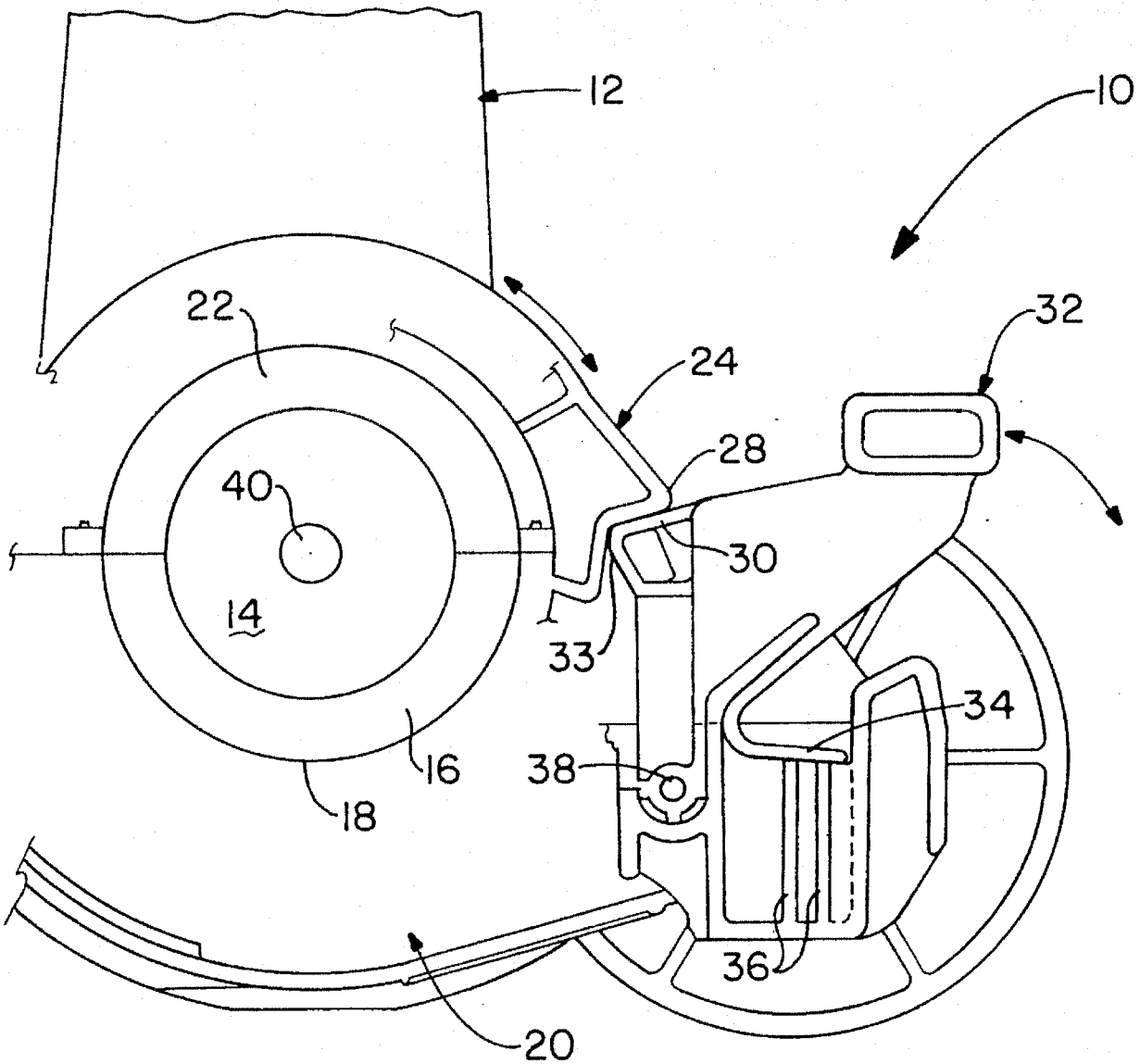
FIG. 2 is a similar view of the rearward portion of the cleaner with the cleaner handle in storage position.
Figure 3:
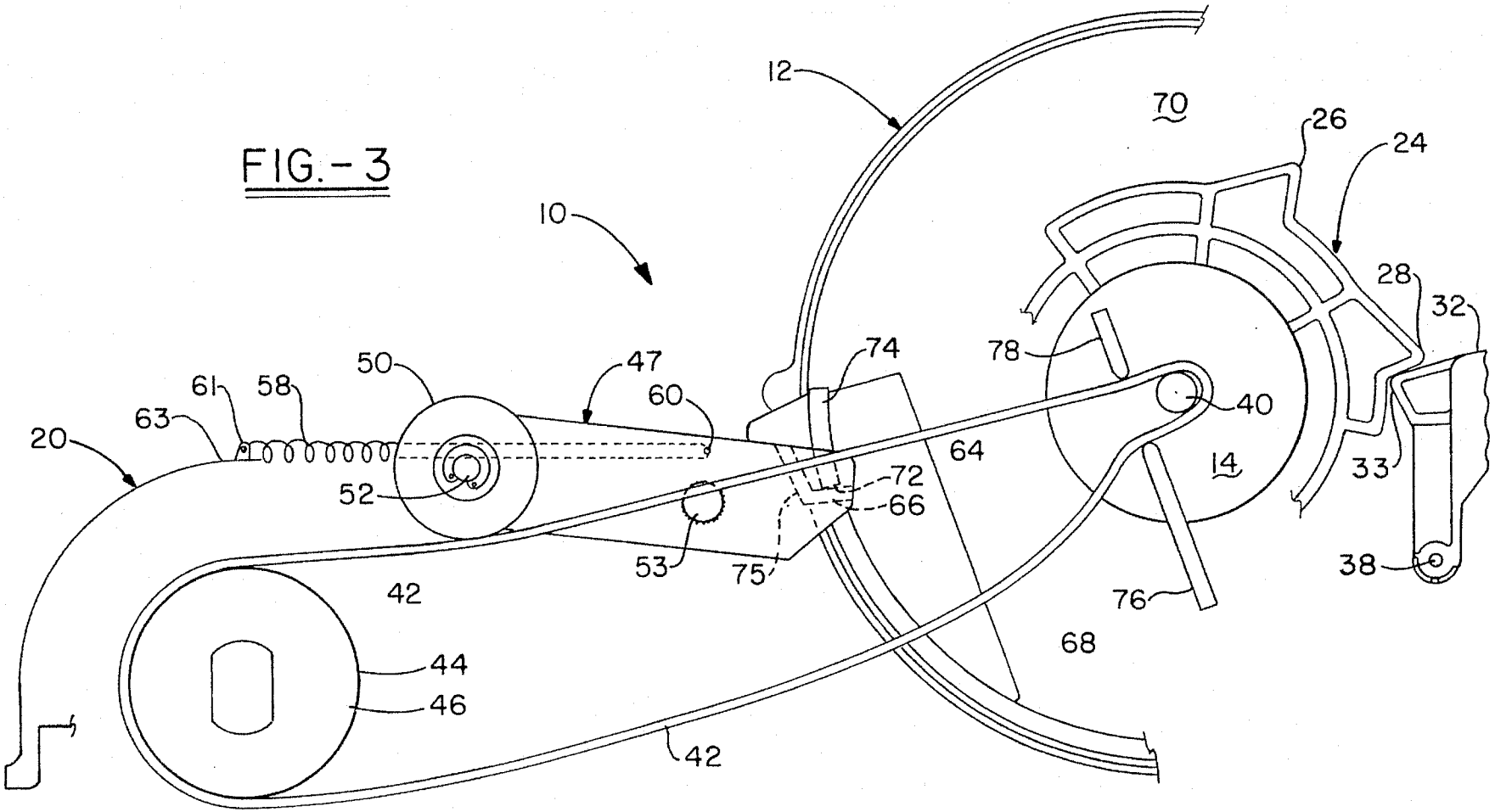
FIG. 3 is a view similar to FIG. 1 but with the agitator drive belt in released condition as dictated by the cleaner handle being in stored position.
Figure 4:
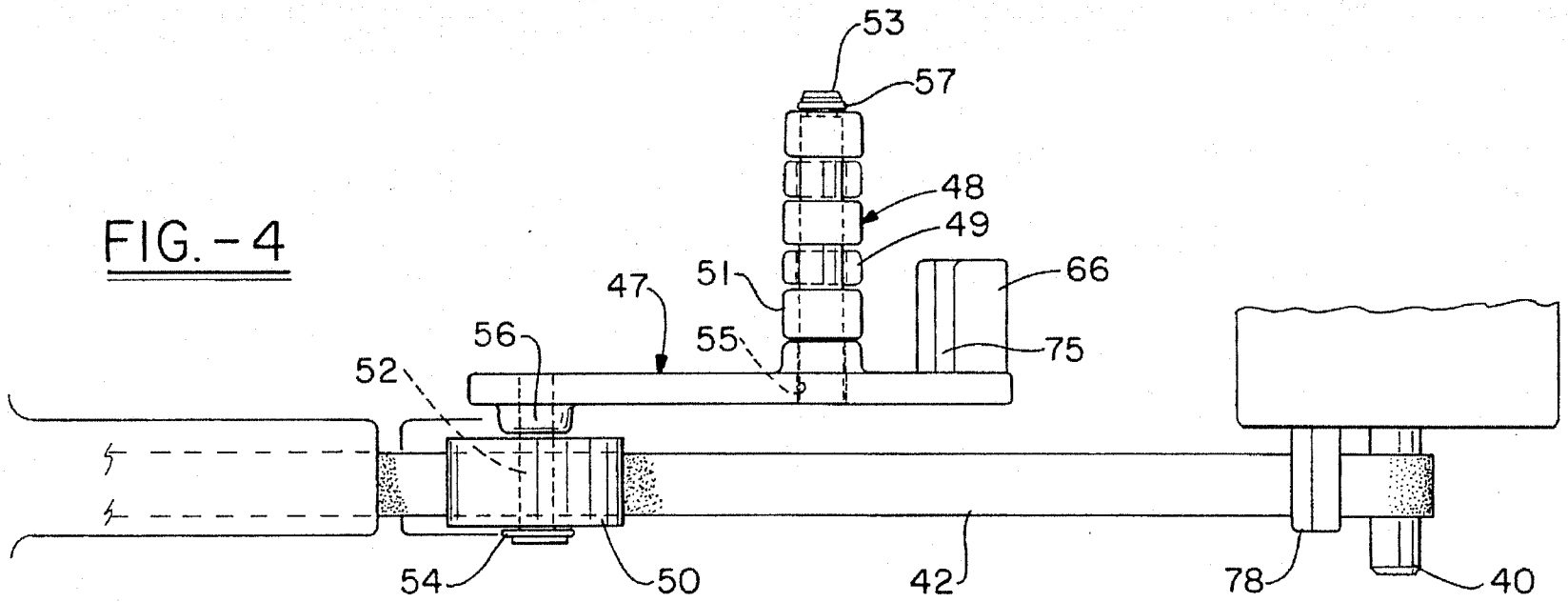
FIG. 4 is a partial plan view of the vacuum cleaner belt and associated elements.
Figure 6:
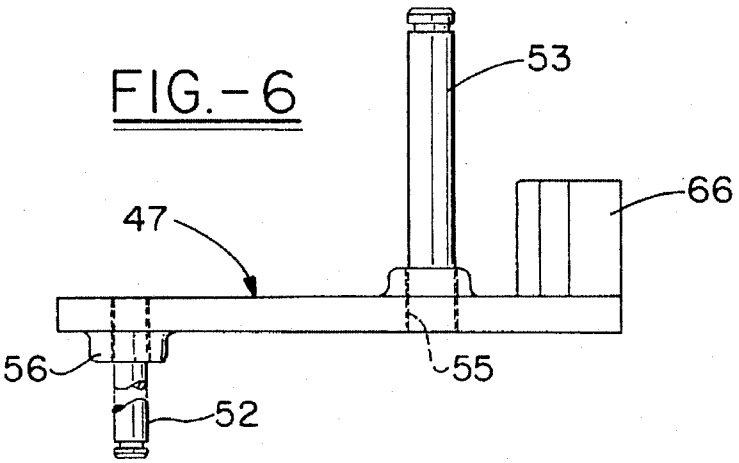
FIG. 6 is a plan view of this same link.
Figure 5:
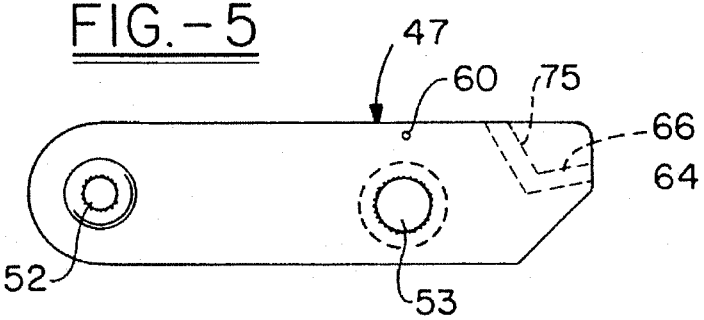
FIG. 5 is a side view of the rollered strut or link utilized for belt tensioning purposes.

There is shown somewhat fragmentarily in FIGS. 1, 2 and 3, a vacuum cleaner 10 having a handle 12 which includes a pivot boss 14 received in a two part yoke 16 having a lower half 18 integrally formed with the nozzle 20 and an upper half 22 mounted thereon by screws or the like. A similar journalling arrangement (not shown) is provided at the other side of the nozzle 20.

Handle 12 includes an integral, generally arcuate lock piece 24 having upper and lower pointed tooth like, catch parts 26, 28 that define the normal operating range of swing of the handle 22 therebetween. A locking pawl 30, integral with a foot operated pedal 32, engages by a projecting point 33 below and behind the lower catch part 28 when the handle 22 is put in storage position and below and behind the upper catch part 26 at the top point of the normal handle operating range (not shown). The foot operated pedal 32 also includes an integral leaf spring 34 which engages against a pair of upstanding walls 36, 36 integral with the nozzle 20 to urge it and locking pawl 30 in a counterclockwise engaging direction. Also, an integral pivot axle 38 mounts the foot pedal 32 rotationally in the nozzle 20.

Centrally located and extending outwardly of the handle pivot boss 14, is a motor driven shaft 40 which frictionally drives, as is conventional, an agitator belt 42. Since this belt is put under a loaded tension so that the structure may function properly, a non stretch belt is preferable for this application which also gives the advantage of longer life. Belt 42 extends forwardly from motor drive shaft 40 to be situated around a pulley section 44 of an agitator 46 so as to drive the agitator 46 when the belt drive arrangement is in drive condition.

In order to tension the belt 42, a pivoting strut or link 47 is provided, intermediate its ends with a fixed pivot boss 48 formed in the nozzle 20 intermediate its front and rear ends. This boss is shaped with alternate upwardly opening and downwardly opening hollow, half cylinders 49, 51 to provide a moldable interleaving effect to yield a through bore for the reception of a shaft 53. This shaft is serrated (not shown) and force fit to be fixedly mounted in a bore 55 in the swinging link 47. The opposite end of the shaft 53 is mounted by a C-clip 57.

The pivoting strut or link 47 includes a roller 50 at its belt contacting end mounted rotatably on a fixed shaft 52 extending from the pivoting strut 47. A C-clip 54 and an enlarged boss 56 of swinging lever 47 maintain this roller axially, with the shaft 52 having a knurled end (not shown) force inserted in a bore extending through swinging link 47 so that it remains fixed relative to this link.

Disposed between an aperture 60 of link 47 and an integral pip 61 on a front top 59 of the nozzle extends a tension spring 58 having hooked ends. This arrangement insures that the pivoting strut 47 always is urged counter-clockwise into engagement with the belt 42 to tension it so that the agitator 46 is driven rotatably. Because of the positioning of the end of the tension spring, the tensioning force applied to cleaner bolt 42 tends to remain constant since, as spring force decreases, the moment arm through which it is applied increases.

In order to release the agitator drive the pivoting link 47 includes on its opposite end an inturned end section 64 that includes an upwardly facing horizontal end face piece 66. This end face piece extends within an arcuate sector shaped discontinuity 68 in a motor housing section 70 of the handle 12. This freely permits the handle 12 to pivot in its cleaning operating range without interference. However, as the handle 12 moves to locked, storage position, with the projecting point 33 of locking pawl 30 moving below catch piece 28 of lock piece 24, the end face piece 66 of pivoting link 40 is engaged by a bottom face 72 formed by the termination of discontinuity 68 of motor housing section 70. Bottom face 72 is formed not only by the wall thickness of the cylindrical shape of the motor housing section 70 but by the bottom side of a right angled small, integral tab 74 extending rearwardly of the nozzle 20.

The end face piece 66 of swinging link 47 is reinforced by an angular joining wall 75 that is angled in such a manner as to clear the handle motor housing section 70 during swinging movement of the handle. When the handle 12 is put in storage position (FIG. 3) it is now clear that the pivoting strut 47 is forced clockwise away from its tensioning position with the belt 42. This permits the belt to assume a non-driving relationship with the agitator 46, placing it in a loosened condition as it extends around the agitator pulley 44 and the motor shaft 40. In this position it is both at rest and easily removed, if desired.

In order to insure that little wear occurs to the belt 42 in this position, by the still rotating motor shaft 40, a pair of belt guards 76, 78 are furnished adjacent this shaft. Belt guard 76 is comprised of an angularly extending strut which is fixedly mounted to or integral with (neither shown) the nozzle 20. Belt guard 78 is a somewhat similar, angularly disposed strut mounted fixedly to the pivot boss 14 of handle 12. Because of their center to center differences, the inner ends of these guards engage the belt 42 as the handle 12 of cleaner 10 swings forwardly, into storage position (FIG. 3). This causes an exaggerated loop like formation to the belt 42 at this end on the nozzle 20 removing it from all but minimal contact with the shaft 40.

It should be clear now that the invention described fully meets all the advantages advance for it at the beginning of this Specification. Further, it also should be clear from it that many modifications could obviously be made to its structure with would still fall within its attendant spirit and purview.

What is claimed is:

1. A vacuum cleaner including:

a) an agitator;

b) a belt driving said agitator:

c) a tensioning link engageable with said belt to thereby tension it for driving said agitator;

d) a nozzle for said vacuum cleaner;

e) a handle for said vacuum cleaner;

f) a pivot disposed between said handle and said nozzle for pivotally mounting said handle to said nozzle;

g) a pivot for said tension link on said nozzle for pivoting said tension link relative to said nozzle for engagement or disengagement with said belt;

h) said nozzle having a forward and rearward direction;

i) said tension link extending axially along said nozzle in said forward and rearward direction;

j) said tension link being in the form of only an elongated straight strut;

k) an engagement tab fixed on said handle, movable with said handle as said handle pivots relative to said nozzle;

l) an engageable tab fixed on said tension link for engagement by said engagement tab during said handle pivoting; and m) said engageable tab being attached to said tension link intermediate its ends and extending along said straight strut form in said axial direction and disposed so as to extend outwardly therefrom for said engagement by said engagement tab.

2. A vacuum cleaner according to claim 1 wherein:

a) a belt guard is mounted on said handle;

b) said belt guard moving with said handle when said handle is pivoted to thereby directly, abuttingly engage said belt.

3. A vacuum cleaner according to claim 1 wherein:

a) only a single engageable tab is utilized in said vacuum cleaner.

* * * * *